US006603250B2

(12) United States Patent
Shaffer

(10) Patent No.: US 6,603,250 B2
(45) Date of Patent: Aug. 5, 2003

(54) CATHODE COATING FOR THERMIONIC ARC DISCHARGE LAMP CATHODES

(75) Inventor: John W. Shaffer, Danvers, MA (US)

(73) Assignee: Osram Sylvania Inc., Danvers, MA (US)

( * ) Notice: Subject to any disclaimer, the term of this patent is extended or adjusted under 35 U.S.C. 154(b) by 37 days.

(21) Appl. No.: 09/940,207

(22) Filed: Aug. 27, 2001

(65) Prior Publication Data

US 2003/0048058 A1 Mar. 13, 2003

(51) Int. Cl.[7] ..... H01J 19/06
(52) U.S. Cl. ..... 313/346 R; 313/345
(58) Field of Search ..... 313/450, 491, 313/574, 628, 632, 341, 345, 346 R

(56) References Cited

U.S. PATENT DOCUMENTS 4,302,702 A * 11/1981 Montgaillard et al. ..... 313/348
5,744,905 A * 4/1998 Mehrotra et al. ..... 313/491

* cited by examiner

*Primary Examiner*—Vip Patel
(74) *Attorney, Agent, or Firm*—Carlo S. Bessone

(57) ABSTRACT

An arc discharge lamp has an evacuated, electromagnetic-energy-transmissive envelope having therein an arc generating and sustaining medium. At least one thermionic, electron-emitting cathode is positioned within the envelope, and the cathode has an electron emissive coating thereon containing silicon carbide.

6 Claims, 1 Drawing Sheet

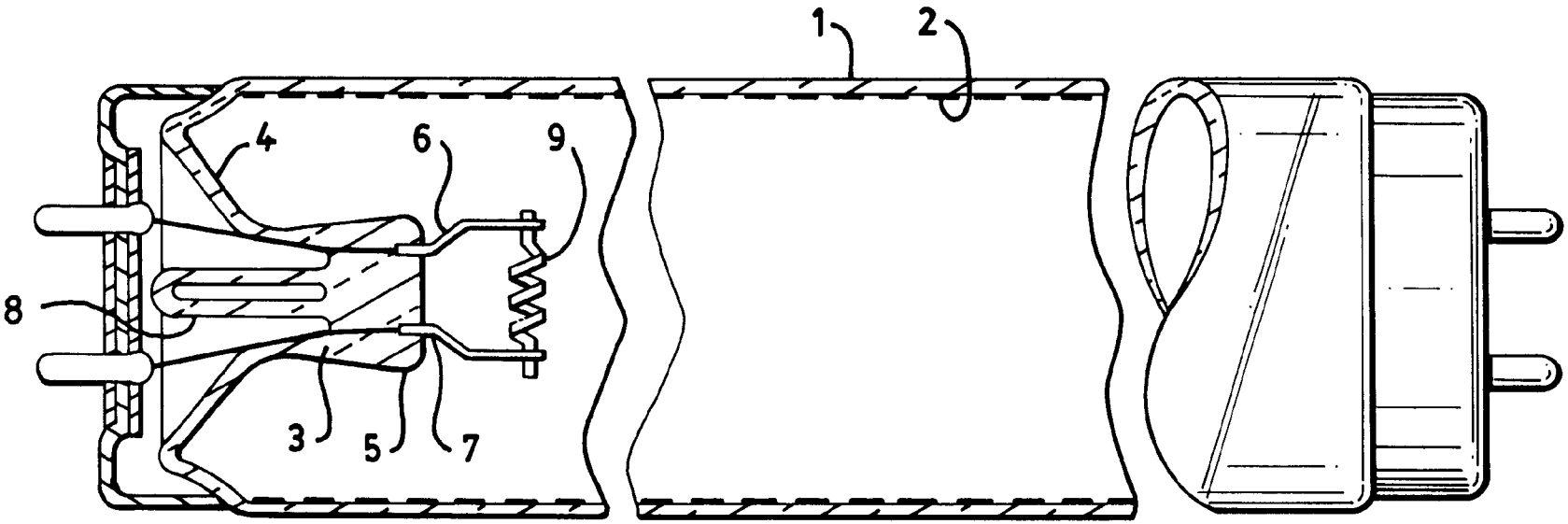
1
2
9
6
7
5
3
4
8

CATHODE COATING FOR THERMIONIC ARC DISCHARGE LAMP CATHODES

TECHNICAL FIELD

This invention relates to electron emissive coatings for thermionic cathodes. More particularly, it relates to such cathodes for arc discharge lamps. Still more particularly, it relates to such coatings having a lowered work function and thus lowered lamp starting voltages and increased lamp efficacy.

BACKGROUND ART

Thermionic cathodes are employed as the electron source in many applications, including arc discharge light sources such as fluorescent lamps. For many years these cathodes have used an emissive material coated upon a tungsten or similar coil, which is heated by the passage therethrough of an electric current. The emissive material has been applied as the carbonates of barium, calcium, strontium and, occasionally, zirconium oxide. This material is subsequently subjected to thermal breakdown during lamp processing, whereby the carbonates are decomposed to the respective oxides.

The life of a fluorescent lamp is determined primarily by the evaporative life of the cathode coating. The vapor pressure of barium oxide as a function of temperature is described by the following equation:

$$\log_{10}P_{mm}=-(19{,}700/T)+8.87$$

where T is the temperature in Kelvins. Since the rate of evaporation is such a strongly temperature dependent function even rather modest changes in cathode operating temperature can have a profound effect on lamp life.

It would be an advance in the art if this emissive material could be changed to provide an even lower work function, which in the case of fluorescent lamps, would result in lower lamp discharge voltage with a concomitant increase in lamp efficacy, reduced cathode hot spot temperature, a reduction in lamp starting voltage, and an increase in life.

DISCLOSURE OF INVENTION

It is, therefore, an object of this invention to obviate the disadvantages of the prior art.

It is another object of the invention to enhance the operation of thermionic cathodes.

Yet another object of the invention is an improved fluorescent lamp.

These objects are accomplished, in one aspect of the invention, by the provision of an electron emissive coating for a thermionic cathode that comprises the oxides of barium, calcium, strontium and optionally zirconium and an effective amount of silicon carbide to increase the electron emissivity of said coating over that of a similar coating without the silicon carbide.

These objects are further accomplished by the provision of a thermionic cathode that comprises a tungsten coil and an electron emissive coating on the tungsten coil. The coating comprises the oxides of barium, calcium, strontium and optionally zirconium and an effective amount of silicon carbide to increase the electron emissivity of the coating over that of a similar coating without the silicon carbide.

The objects are still further accomplished by the provision of an arc discharge lamp that comprises an evacuated, electromagnetic-energy-transmissive envelope; an arc generating and sustaining medium within the envelope; and at least one thermionic, electron-emitting cathode within the envelope, the cathode having an electron emissive coating thereon containing silicon carbide.

The use of the invention described herein results in a reduction in work function, a lowering of cathode voltages and a longer life for lamps in which they are employed.

BRIEF DESCRIPTION OF THE DRAWINGS

The single FIGURE is a diagrammatic representation of a fluorescent lamp, partially in section, employing the invention.

BEST MODE FOR CARRYING OUT THE INVENTION

For a better understanding of the present invention, together with other and further objects, advantages and capabilities thereof, reference is made to the following disclosure and appended claims in conjunction with the above-described drawing.

Referring now to the drawing with greater particularity, there is shown in the FIGURE a fluorescent lamp having an evacuated, electromagnetic-energy-transmissive envelope 1. By electromagnetic energy is meant radiation in the visible or invisible portions of the spectrum and includes without limitation ultraviolet radiation. A phosphor coating 2 can be provided on the interior surface of the envelope. An electrode stem 3 seals the ends of the envelope. The electrode stem comprises the flare 4 and the stem press (pinch) seal 5 through which the lead-in wires 6 and 7 extend. It also contains the exhaust tube 8. The electrode coil, which is preferably of tungsten, is coated with the oxide paste of the invention. An amalgam and suitable atmosphere are provided within the envelope to generate and sustain an arc when the lamp is operating, as is known in the art.

In general, the emissive coating of the invention is prepared by creating a suspension of the mixed carbonates of barium, calcium and strontium together with zirconium dioxide. The materials are milled in an amyl acetate vehicle together with cellulose trinitrate as a binder. The cathode coating suspension so formed is then applied to tungsten coils.

In a particular embodiment, the coating suspension was applied to the tungsten coils of 13 watt twin tube fluorescent lamps. The average dried coating weight was 1.50 mg. After subjection to thermal breakdown during lamp processing the carbonates are decomposed to the respective oxides. The composition of the final resultant emissive oxide coating, by weight percent, was barium oxide 48.1, strontium oxide 38.36, calcium oxide 6.86, and zirconium oxide 6.77.

Test lamps were made by taking a quantity of the above described coating suspension and adding to it powdered silicon carbide having a beta crystallographic structure and having a particle size of 1 micron. The quantity of SiC added was such that it comprised 10 volume percent of the final oxide coating. The test lamps and the control lamps were processed identically and on the same day. The average dried coating on the test lamps was 1.36 mg.

The test and control lamps were operated on a standard life rack for 20 hours and then photometered. Although the test size was small, the differences in lamp voltage and efficacy were shown to be statistically significant at the 95 percent confidence level by the standard Student's t-test. The results are shown in TABLE I.

TABLE I

| | New Coating | Control | Difference (Test-Control) |
|---|---|---|---|
| No. of Lamps | 6 | 2 | — |
| Average Voltage | 61.88 | 63.15 | −1.27 |
| Average Current (amps) | 0.2739 | 0.2709 | +0.003 |
| Average Watts | 13.88 | 14.09 | −0.21 |
| Average Lumens | 800 | 801 | 0 |
| Average Lumens/Watt | 57.66 | 56.85 | +0.81 |

"Zero Hour" Lamp Discharge Voltage Test

Additional test and control lamps of the 13 watt twin tube type were prepared using the same modified and unmodified cathode coating suspensions as used for the test in Table I. The average dried coating weights for these test lamps were, respectively, Control 2.6 mg, and Test 2.5 mg. After processing, the lamps were put into a 120° C. oven for a few minutes to distribute the mercury. Lamp discharge voltage was then measured after one minute operation on a 60 Hz instant start magnetic ballast. Even with the small test size a Student's t-test showed the results to be statistically significant, with an estimated probability of error of less than 0.001. These results are shown in TABLE II.

TABLE II

| | Test | Control | Difference (Test-Control) |
|---|---|---|---|
| No. of Lamps | 4 | 6 | — |
| Average Discharge Voltage | 66.75 | 70.75 | −4.0 |

"Zero Hour" Lamp Start Voltage Test

The starting voltage of the test lamps shown above in TABLE II was measured at 60 Hz using the magnetic instant-start ballast driven from a Variac. The minimum voltage needed to initiate a discharge in the lamp was measured as the input voltage to the ballast slowly ramped up. Here, too, the results were shown to be statistically significant, with estimated probability of error of less than 0.001. The results are shown in TABLE III.

TABLE III

| | Test | Control | Difference (Test-Control) |
|---|---|---|---|
| No. of Lamps | 4 | 6 | — |
| Average Start Voltage | 456.2 | 474.5 | −18.3 |

In order to evaluate the effect of differing concentrations of silicon Carbide in the cathode coating several modified test batches were prepared, with the silicon carbide additions shown in TABLE IV.

TABLE IV

| Coating (and test lamp) group | Grams of one micron, beta SiC added per 10.0 grams of cathode coating suspension: |
|---|---|
| 1 | 0.11 |
| 2 | 0.29 |
| 3 | 0.52 |

TABLE IV-continued

| Coating (and test lamp) group | Grams of two micron, alpha SiC added per 10.0 grams of cathode coating suspension: |
|---|---|
| 4 (Control) | 0 |
| 5 | 0.11 |
| 6 | 0.29 |

The composition of the control cathode coating as a percent by weight of the oxides following breakdown was approximately 57.5 barium oxide, 28.5 strontium oxide, 15.0 calcium oxide, and 5.0 zirconium dioxide. The non-volatiles content of the control suspension was 66 percent.

The lamps employed for both the test and control were 26 watt Dulux D/E lamps available from Sylvania and were made from the suspension listed in TABLE IV. The lamps were operated on a life test rack, and five from each group were photometered at 100 hours and 200 hours as shown in TABLE V.

TABLE V

| Coating used: | Average Lamp Volts, 100 Hours | Std. Dev. Volts | Average Lumens/Watt | Std. Dev. Lumens/Watt |
|---|---|---|---|---|
| 1 | 109.7 | 0.540 | 67.9 | 0.565 |
| 2 | 110.7 | 0.688 | 67.8 | 0.729 |
| 3 | 110.3 | 0.942 | 67.9 | 0.821 |
| 4 (Control) | 111.0 | 1.022 | 67.1 | 0.662 |
| 5 | 109.6 | 1.324 | 68.1* | 0.631 |
| 6 | 109.3 | 1.461 | 69.6* | 0.221 |
| | | 200 Hours | | |
| 1 | 108.1 | 0.981 | 66.1 | 0.549 |
| 2 | 108.4 | 1.268 | 66.4 | 0.319 |
| 3 | 108.2 | 1.122 | 67.1* | 0.824 |
| 4 (Control) | 109.1 | 0.958 | 65.7 | 0.570 |
| 5 | 107.1* | 0.789 | 66.9* | 0.488 |
| 6 | 106.3* | 1.381 | 69.0* | 0.577 |

One-way ANOVA statistical analyses of the test group results relative to the control group were carried out at the 0.05 level. Those test results showing statistical significance at the 0.05 level are designated with an asterick. These results on these test groupings show a clear benefit from the addition of silicon carbide to the cathode coating.

Cathode Hot Spot Temperature Test #1

Additional test and control lamps of the same type as above (i.e., 26 watt Dulux D/E) were made at the same time using the cathode suspensions shown in TABLE V. These latter lamps were fabricated with a clear, phosphor-free area at the lamp ends to permit observation of the cathode during operation. They were then operated on a life test rack for 300 hours. The temperature of the hot spot on each cathode was then measured with MicroOptical Pyrometer while the lamps were driven from a magnetic ballast at 60 Hz. The identity of the test group cathode coatings is identical to that of the preceding test shown in TABLE V. The significance of the cathode hot spot temperature versus that of the control group, as indicated by one-way ANOVA, is again shown by asterisks. Groups 1 and 3 are significant at the 0.05 level; Group 5 at the 0.001 level and Group 6 at the 0.02 level.

Again, high statistical significance is shown in spite of the small test groups used. These results are shown in TABLE VI.

TABLE VI

| Cathode Coating Used | No. Of Coils Measured | Av. Hot Spot Temp. Kelvins | Standard Deviation |
|---|---|---|---|
| 1 | 6 | 1030* | 12.7 |
| 2 | 6 | 1035 | 22.0 |
| 3 | 6 | 1026* | 17.5 |
| 4 (Control) | 6 | 1062 | 24.6 |
| 5 | 6 | 1002* | 19.8 |
| 6 | 6 | 1018* | 25.6 |

Cathode Hot Spot Test #2

The second cathode hot spot test was conducted with similar 26 watt Dulux D/E lamps; different tungsten coils were used as well as argon buffer gas pressures of 4.5 and 3.0 Torr. The cathode coatings with intermediate levels of silicon carbide, i.e., batches 2 and 6, were compared to control coating no. 4. After 150 hours of operation the hot spot temperatures were measured as above. The small test group size and comparatively large standard deviations in this test resulted in only one of the silicon carbide groups showing significance by ANOVA at the 0.05 level. The results are shown in TABLE VII.

TABLE VII

| Cathode Coating Used: 4.5 Torr Argon | Number of Coils Measured | Average Hot Spot Temperature, Kelvins | Standard Deviation |
|---|---|---|---|
| 2 | 6 | 1038 | 43.7 |
| 4 (Control) | 6 | 1093 | 43.7 |
| 6 | 6 | 1056 | 15.3 |
| | 3.0 Torr Argon | | |
| 2 | 6 | 1027 | 16.9 |
| 4 (Control) | 6 | 1075 | 49.1 |
| 6 | 6 | 1028 | 18.1 |

These test results show that the addition of silicon carbide to the mixed oxide cathode coatings, as applied to low pressure discharge devices such as fluorescent lamps, offers benefits in reduced hot spot temperatures that will translate into increased lamp life and apparent lowered cathode fall voltage that increases lamp efficacy.

Further, it has been shown that the reduced work function will have applicability to all forms of thermionic cathodes, thereby providing longer life for those devices.

The optimum percentage of silicon carbide for use in cathode coatings will most likely vary from one application to another. However, measurable benefits are expected to occur from one or a few percent by weight up to 40 percent or higher, based on the final weight of the oxides present.

Thus, there is provided by this invention a new cathode emissive material, new cathodes, and new arc discharge lamps, specifically, fluorescent lamps.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An electron emissive coating for a thermionic cathode comprising:

oxides of barium, calcium, strontium and zirconium and an effective amount of silicon carbide to increase electron emissivity of said coating.

2. The electron emissive coating of claim 1 wherein said oxides of barium, calcium, strontium and zirconium form a first material comprised of, by weight, about 48.1% barium oxide, about 6.86% calcium oxide, about 38.36% strontium oxide, and about 6.77% zirconium oxide and said silicon carbide comprises about 10 volume % of said first material.

3. A thermionic cathode comprising:

a tungsten coil; and an electron emissive coating on said tungsten coil, said coating comprising oxides of barium, calcium, strontium and zirconium and an effective amount of silicon carbide to increase electron emissivity of said coating.

4. A thermionic cathode comprising:

an electron emissive coating including oxides of barium, calcium, strontium and zirconium and an effective amount of silicon carbide to increase electron emissivity of said coating.

5. An arc discharge lamp comprising:

an evacuated, electromagnetic-energy-transmissive envelope;

an arc generating and sustaining medium within said envelope; and at least one thermionic, electron-emitting cathode within said envelope, said cathode having an electron emissive coating thereon containing oxides of barium, calcium, strontium and zirconium and an effective amount of silicon carbide to increase electron emissivity of said coating.

6. The arc discharge lamp of claim 5 wherein said lamp is a fluorescent lamp.

* * * * *